US006601568B1

(12) United States Patent
Muller

(10) Patent No.: US 6,601,568 B1
(45) Date of Patent: Aug. 5, 2003

(54) DIESEL FUEL RE-PRIMING DEVICE FOR FUEL BURNING APPARATUS

(76) Inventor: Wilhelm Muller, P.O. Box 1576, Cardston, Alberta (CA), T0K 0K0

( * ) Notice: Subject to any disclaimer, the term of this patent is extended or adjusted under 35 U.S.C. 154(b) by 0 days.

(21) Appl. No.: 09/442,098

(22) Filed: Nov. 17, 1999

(51) Int. Cl.[7] ..... F02M 37/04
(52) U.S. Cl. ..... 123/510; 123/198 DB
(58) Field of Search ..... 123/198 D, 198 DB, 123/510, 516; 137/395; 417/36, 38, 44.3

(56) References Cited

U.S. PATENT DOCUMENTS

| | | | | | |
|---|---|---|---|---|---|
| 2,297,238 | A | * | 9/1942 | Neugebauer et al. | 123/516 |
| 2,918,911 | A | | 12/1959 | Guiot | |
| 3,202,143 | A | | 8/1965 | Goodwin | |
| 3,590,798 | A | | 7/1971 | Goodwin | |
| 3,738,346 | A | * | 6/1973 | Goodman | 123/198 DB |
| 4,020,814 | A | * | 5/1977 | Hewitt et al. | 123/359 |
| 4,187,824 | A | * | 2/1980 | Connolly | 123/198 F |
| 4,265,262 | A | * | 5/1981 | Hotine | 137/2 |
| 4,294,204 | A | * | 10/1981 | Hurner | 123/198 DB |
| 4,763,621 | A | * | 8/1988 | Stevens | 123/198 D |
| 5,105,663 | A | * | 4/1992 | Kuhlen | 73/308 |
| 5,201,298 | A | * | 4/1993 | Shearn | 123/514 |
| 5,526,793 | A | | 6/1996 | Johansson | |
| 5,576,582 | A | * | 11/1996 | White | 307/118 |
| 5,715,797 | A | | 2/1998 | Minagawa et al. | |
| 5,881,698 | A | * | 3/1999 | Tuckey et al. | 123/497 |
| 5,894,857 | A | * | 4/1999 | Takaki et al. | 137/395 |
| 5,913,294 | A | * | 6/1999 | Takahashi et al. | 123/198 DB |

FOREIGN PATENT DOCUMENTS

| | | |
|---|---|---|
| DE | 3411539 A1 | 1/1984 |
| DE | 19612413 A1 | 10/1997 |
| GB | 851213 | 10/1960 |
| GB | 1168489 | 10/1969 |
| GB | 1222820 | 2/1971 |
| GB | 2 140 091 A | 11/1984 |

* cited by examiner

*Primary Examiner*—Carl S. Miller
(74) *Attorney, Agent, or Firm*—J. Mark Holland

(57) ABSTRACT

A control device 10 for isolating a fuel line 4 from its source 1 and its discharge 7 and preventing line 4 from getting vapor locked when its source 1 runs low or empty. The device combines a sensing device 2 at the fuel line intake and an activation device 3 for disabling fuel flow to a combustion engine at the other end. When fuel runs low or empty, the activation device 3 automatically isolates the fuel line from the reservoir 1 and the engine 7 to prevent the fuel line from further drawing down. Under this protection and upon refueling the reservoir, the fuel line has enough fuel to start back up without first having to re-prime the fuel line.

14 Claims, 2 Drawing Sheets

DIESEL FUEL RE-PRIMING DEVICE FOR FUEL BURNING APPARATUS

This invention generally relates to method and apparatus for maintaining full fuel in a fuel supply line, and more specifically to a supply line of a diesel burning system.

BACKGROUND OF THE INVENTION

Non-ignition type engines such as diesel engines have been around for years. Unlike gas combustion engines which operate by vaporizing a fuel chamber with fuel and igniting the fuel with sparks, commonly from a spark plug, diesel engines operate under high pressure and without any sparks. At a certain range of pressure and temperature, diesel fuel self ignites in an exothermic reaction to give off the necessary energy or power to propel the engine.

However, diesel engines have several shortcomings. Among them, when a diesel supply reservoir runs low on fuel, the fuel supply line typically becomes less "full" and at some point even dries up and "gases" up (rather than staying filled with "liquid" diesel fuel), leading ultimately to a loss of power from fuel starvation. When the reservoir is refueled, engine startup is not necessarily guaranteed. Trapped air in the fuel line can prevent fuel from properly filling and flowing, a symptom commonly referred to as "vapor lock". More often than not, the vapor must be purged from the line before the fuel line can properly be filled, a task is typically costly (if the user has to take the vehicle in for repair), inconvenient, and time consuming.

OBJECTS AND ADVANTAGES OF THE INVENTION

It is therefore an object of the present invention to supply an apparatus (which, as used herein, includes any system or any physical embodiment of the present invention) and related method capable of maintaining a full fuel line despite having the fuel reservoir running low or even empty. The preferred embodiment of the invention includes fuel sensors, a shut-off valve, and a check valve for isolating the fuel line from the engine and the reservoir until the reservoir can be refueled.

It is a further object of the invention to supply a fuel line of the aforementioned character in which the fuel line is capable of immediate fuel flow without first purging the line of entrapped gas.

Another object of the present invention is to supply a fuel line that is unaffected by the engine status or the reservoir level.

Other objects and advantages of the invention will be apparent from the following specification and the accompanying drawing, which are for the purpose of illustration only.

DETAILED DESCRIPTION OF THE PREFERRED EMBODIMENT

Figure 1:
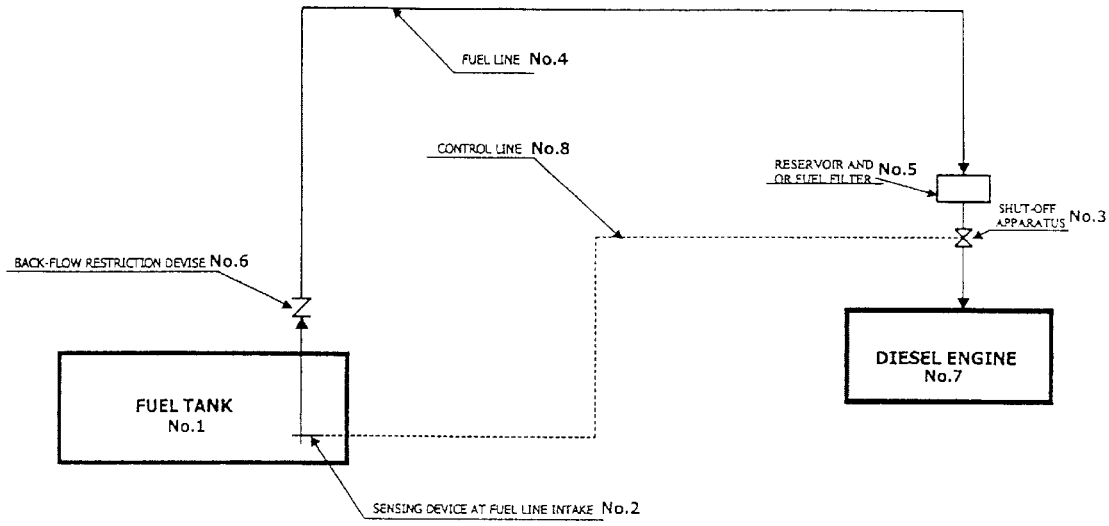
FIG. 1 is a block flow diagram of the preferred embodiment.
Figure 2:
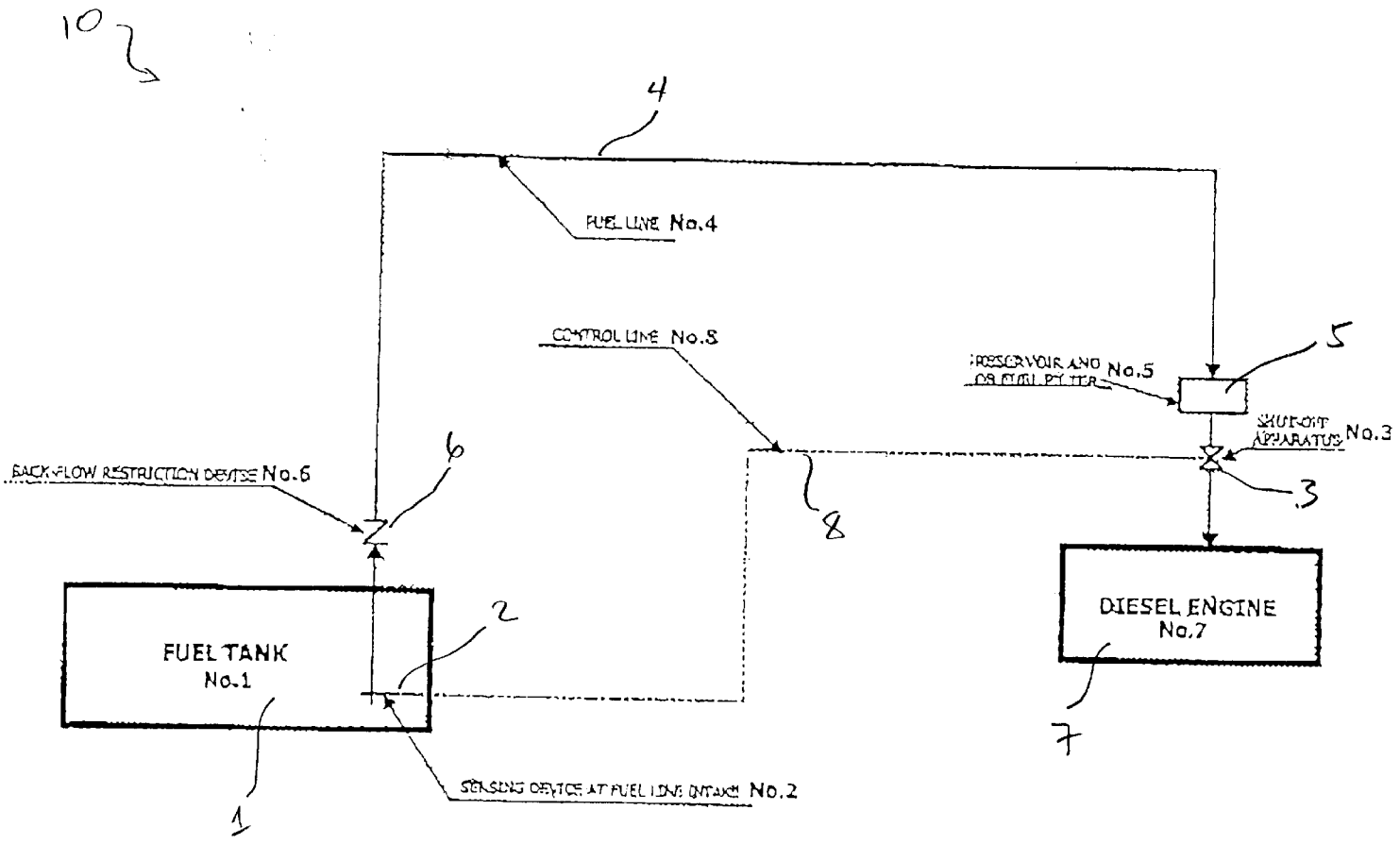
FIG. 2 is an identical but larger view of FIG. 1 with number elements.

The preferred embodiment of the invention can be more fully appreciated by reference to the drawing and the following description. Referring to FIG. 1, we show a preferred embodiment 10 configured in accordance with the teachings of the invention. The invention can be a retrofit of an existing diesel engine or a new configuration of a new engine.

The system preferably includes a fuel tank 1, a fuel line 4 connecting the tank 1 and the engine 7, and various other components therebetween. By way of example, the fuel line preferably includes a check valve or back flow preventer 6 configured for flow from the reservoir or tank 1 to the engine 7, a fuel pump (not shown) residing either in the tank or adjacent thereto, an overflow or settling tank 5, an optional filter 5, and a control valve 3. However, persons of ordinary skill in the art will understand that other features may be added without deviating from the spirit of the invention, including purging points, insulated lines, and multiple control valves instead of or in addition to the check valve 6.

In general terms, when the engine is running, fuel is pumped from the reservoir 1 via fuel line 4 to engine 7. Fuel flow or fuel supply is preferably gauged by a sensing device 2. The sensing device 2 can be of a variety of type, including a level gauge or a flow gauge, as would be understood by a person of ordinary skill in the art. Preferably, the sensing device 2 of apparatus 10 is a commercially available level gauge coupled with a level controller 3 that is set-up to automatically shut off and isolate the fuel line 4 at some critical reservoir 1 level. However, persons of ordinary skill in the art will understand that a flow controller or possibly a pressure controller can implement our invention with equal effectiveness. That is, by sensing the flow, assuming a flow controller is used, the control valve can be configured to automatically shut off fuel supply at some critical fuel flow. Typically, fuel flow decreases as head pressure to the fuel pump decreases, due to lower fuel level.

Preferably, when the reservoir 1 is low or fuel flow in fuel line 4 is low, whatever the case may be, control valve 3 is actuated and closes shut. Because check valve 6 is configured to flow in the direction of the engine, flow is prevented from "back flowing" into the reservoir. Hence, in the described dynamic setting, the engine 7 is fuel starved and shuts down, but the fuel line 4 remains full.

Assuming the system comprises a diesel truck or a diesel car (i.e., a vehicle for short), when the aforementioned conditions occurred, the vehicle stalls and comes to a complete stop. The driver then, either by towing the vehicle to a fueling station or by using a fuel canister, fuels up the car and restarts the vehicle. Upon start up, the fuel pump pumps diesel to the fuel line 4 and the control valve 3 moves the valve gate to the open position, due to a "higher" reservoir level. Person of ordinary skill in the art however will understand that the foregoing sequence is merely illustrative and that similar systems may be configured to restart flow differently, including opening the control valve 3 before initiating the fuel pump or activating them simultaneously.

Because the fuel line remains full, even with a low tank or a low flow, air or gas is never introduced into the fuel line 4. Thus, upon the aforementioned startup, purging is not necessary since the system is never "vapor locked".

Sensing device 2 and control valve 3 are interconnected via control line 8. Preferably control line 8 is an electrical cable capable of, among other things, data and control transmission. By way of example, when the reservoir 1 is low, the sensing device 2 sends a signal to a controller informing the controller of the low level status. The controller (not shown) then sends a signal to an actuator, a servomotor or a solenoid valve, for example, to switch the valve gate 3 to a close position.

The apparatus and methods of our invention have been described with some particularity, but the specific designs, constructions and steps disclosed are not to be taken as delimiting of the invention. Obvious modifications will make themselves apparent to those of ordinary skill in the art, all of which will not depart from the essence of the invention and all such changes and modifications are intended to be encompassed within the appended claims.

What is claimed is:

1. Apparatus for supplying diesel fuel, said apparatus including a reservoir, a diesel engine, a fuel line between said reservoir and said diesel engine, and a control valve operatively positioned and configured to isolate fuel in said fuel line under certain conditions, wherein said fuel line is isolated when flow in said fuel line is low.

2. Apparatus for supplying diesel fuel, said apparatus including a reservoir, a diesel engine, a fuel line between said reservoir and said diesel engine, and a control valve operatively positioned and configured to isolate fuel in said fuel line so that no vacuum reaches the fuel line under certain conditions, wherein said fuel line is isolated when said reservoir is low on fuel.

3. The apparatus of claim 1 or claim 2, further including at least one of a flow controller and a level controller.

4. The apparatus of claim 1 or claim 2, further including a check valve for preventing back flow to the reservoir.

5. Apparatus for isolating a fuel line between a reservoir and a combustion engine under circumstances of low fuel supply, said apparatus including at least two valves, one such valve near each end of said fuel line, said valves disposed between said reservoir and said combustion engine, said valves being operable under said circumstances of low fuel supply to isolate said fuel line from said reservoir and said engine.

6. The apparatus of claim 5, further including a fuel pump and wherein said fuel line is isolated when said reservoir and said engine when said reservoir level is below the intake of said pump.

7. A method for isolating a fuel line at both ends of said fuel line and preventing said fuel line from getting vapor locked, said method including the steps of:

providing at least one valve at each end of said fuel line;

providing a reservoir and a combustion engine at opposing ends of said fuel line;

providing a sensor at at least one of said ends to sense the presence or condition of fuel at one end of said fuel line;

stopping fuel flow in said fuel line when said sensing detects a sufficient change in fuel condition by automatically activating said at least one valve at each end of said fuel line.

8. The method of claim 7, wherein one of said at least one valve is a check valve.

9. The method of claim 7, further including the steps of providing a fuel pump and a fuel suction line and configuring said fuel pump to shut off when fuel level falls below said suction line.

10. The method of claim 9, further including the steps refueling said fuel reservoir and resuming fuel flow in said fuel line.

11. Apparatus for supplying diesel fuel, said apparatus including a reservoir, a diesel engine, a fuel line between said reservoir and said diesel engine, and a control valve operatively positioned and configured to isolate fuel in said fuel line under conditions of low fuel supply, said isolated fuel substantially filling said fuel line under those conditions.

12. Apparatus for supplying diesel fuel, said apparatus including a reservoir, a diesel engine, a fuel line between said reservoir and said diesel engine, and a control valve operatively positioned and configured to isolate fuel in said fuel line under conditions of low fuel supply, said isolated fuel being a sufficient amount to permit immediate restart without priming upon the subsequent opening of said control valve.

13. Apparatus for supplying diesel fuel, said apparatus including a reservoir, a diesel engine, a fuel line between said reservoir and said diesel engine, and a control valve operatively positioned and configured to automatically keep the fuel line filled with fuel at any time after its initial priming.

14. Apparatus for supplying diesel fuel, said apparatus including a reservoir, a diesel engine, a fuel line between said reservoir and said diesel engine, and a control valve operatively positioned and configured to isolate fuel in said fuel line when the fuel level in said reservoir is low.

* * * * *

UNITED STATES PATENT AND TRADEMARK OFFICE

CERTIFICATE OF CORRECTION

PATENT NO. : 6,601,568 B1
DATED : August 5, 2003
INVENTOR(S) : Wihelm Muller

It is certified that error appears in the above-identified patent and that said Letters Patent is hereby corrected as shown below:

Column 3,
Line 30, after “being”, insert -- automatically --;
Line 32, after “engine”, insert the following -- , wherein said isolated fuel line remains substantially full of fuel under those circumstances --.

Signed and Sealed this

Twenty-second Day of June, 2004

JON W. DUDAS
*Acting Director of the United States Patent and Trademark Office*